US008657290B1

(12) United States Patent
Stevens

(10) Patent No.: US 8,657,290 B1
(45) Date of Patent: Feb. 25, 2014

(54) BLACKJACK GAME WITH SHRIMP CARDS FOR INCREASED PAYOUTS

(75) Inventor: Derek J. Stevens, Warren, MI (US)

(73) Assignee: Desert Rock Enterprises LLC, Las Vegas, NV (US)

( * ) Notice: Subject to any disclaimer, the term of this patent is extended or adjusted under 35 U.S.C. 154(b) by 370 days.

(21) Appl. No.: 12/693,599

(22) Filed: Jan. 26, 2010

(51) Int. Cl.
*A63F 1/00* (2006.01)

(52) U.S. Cl.
USPC ..... 273/292

(58) Field of Classification Search
USPC ..... 273/292
See application file for complete search history.

(56) References Cited

U.S. PATENT DOCUMENTS 6,179,710 B1 * 1/2001 Sawyer et al. ..... 463/16
6,612,580 B1 * 9/2003 Weldon ..... 273/292
6,698,758 B2 * 3/2004 Hodge ..... 273/274
6,932,343 B1 * 8/2005 Miller ..... 273/292
7,040,625 B1 * 5/2006 D'Avanzo ..... 273/292
2006/0281536 A1 * 12/2006 Wright ..... 463/25
2008/0116641 A1 5/2008 Weldon

* cited by examiner

*Primary Examiner* — Kurt Fernstrom
*Assistant Examiner* — Dolores Collins
(74) *Attorney, Agent, or Firm* — Lewis Roca Rothgerber LLP

(57) ABSTRACT

In a Blackjack game, one or more bonus or "Shrimp" cards are introduced into the card decks from which cards are dealt to the players. When a player is dealt a Shrimp card, the next time he is dealt a Blackjack, his winning is increased (preferably doubled). This provides an incentive for the player to increase his level of wagering and the time he plays at the Blackjack table after he has been dealt a Shrimp card. The Shrimp card is forfeit when the player leaves the table, and it is not transferable.

8 Claims, 2 Drawing Sheets

BLACKJACK GAME WITH SHRIMP CARDS FOR INCREASED PAYOUTS

BACKGROUND OF THE INVENTION

1. Field of the Invention

The present invention relates to wagering card games and, more specifically, to an improved Blackjack game utilizing a Shrimp card to increase Blackjack payouts.

2. The Prior Art

Blackjack, also known as Twenty-one, Vingt-et-un (French for Twenty-one), or Pontoon, is the most widely played casino banking game in the world. The basic rules of the game involve adding the value of an initial two card hand in hopes of being dealt a value of twenty-one. If a value of less than twenty-one is dealt, the player may choose to be dealt single cards until they either reach a value of twenty one, reach a value they feel comfortable to play, or reach a value that exceeds twenty-one. The winner holds a hand with a value of, or nearest to, twenty-one without exceeding it. The game is played in many variations at casinos with different table rules. Much of Blackjack's popularity is due to the mix of chance, skill, and the publicity that surrounds card counting (calculating the probability of advantages based on the ratio of high cards to low cards).

Blackjack's precursor was likely "twenty-one," a game of unknown origin. The first written reference is to be found in a book of Miguel de Cervantes, the author of Don Quixote, and a gambler himself. The main characters of his tale "*Rinconete y Cortadillo*", from "*Novelas Ejemplares*", are a couple of cheaters working in Seville. They are proficient at cheating at "veintiuna" (Spanish for twenty-one), and stated that the object of the game is to reach 21 points without busting, and that the Ace values 1 or 11. The game is played with Baraja, that is without tens, which makes the game similar to the current Spanish 21. This short story was written between 1601 and 1602, so the game was played in Castilia since the beginning of the 17th Century or even earlier. Later references of this game are to be found in France and Spain. When 21 was introduced in the United States it was not very popular, so gambling houses tried offering various bonus payouts to get the players to the tables. One such bonus was a 10-to-1 payout if the player's hand consisted of the ace of spades and a black Jack (either the Jack of clubs or the Jack of spades). This hand was called a "Blackjack" and the name stuck to the game, even though the bonus payout was soon abolished. In the modern game, a "Natural" or "Blackjack" is simply an ace plus a ten-value card.

In casino Blackjack, the dealer typically faces one to seven players from behind a kidney-shaped table. Each player plays his hand independently against the dealer. At the beginning of each round, the player places a bet in the "betting box" and receives an initial hand of two cards. The object of the game is to get a higher card total than the dealer, but without going over 21 which is called "busting", "breaking", or many other terms. (The spot cards count 2 to 9; the 10, Jack, Queen, and King count as ten; and an Ace can be either 1 or 11 at the player's choice). The player goes first and plays his hand by taking additional cards if he desires. If he busts, he loses. Then the dealer plays his or her hand. If the dealer busts, he loses to all remaining players. If neither busts, the higher hand total wins. If a player ties with the dealer the hand is a "push" and the player's bet is returned. It is possible for the dealer to lose to some players but still beat other players in the same round.

Cards are typically dealt in three ways, either from one or two hand-held decks, from a box containing four to eight decks called a "Shoe," or from a shuffling machine. When dealt by hand, the player's two initial cards are usually face-down, while the dealer has one face-up card called the "upcard" and one face-down card called the "hole card." (In European Blackjack, the dealer's hole card is typically not actually dealt until the players all play their hands.) When dealt from a shoe, all player cards are normally dealt face-up, with minor exceptions. It shouldn't matter to the non-expert player whether his cards are dealt face-down or face-up since the dealer must play according to predetermined rules. If the dealer has less than 17, he must hit. If the dealer has 17 or more, he must stand (take no more cards), unless it is a "soft 17" (a hand that includes an ace valued as "11", for example a hand consisting of Ace+6, or Ace+2+4). With a soft 17, the dealer follows the casino rules printed on the Blackjack table, either to "hit soft 17" or to "stand on all 17's."

Normally, the highest possible hand is a "Blackjack" or "Natural," meaning an initial two-card total of 21 (an ace and a ten-value card). A player Blackjack is an automatic winner unless the dealer also has Blackjack, in which case the hand is a "push" (a tie). When the dealer upcard is an Ace, the player is allowed to make a side bet called "insurance," in order to guard against the risk that the dealer has a Blackjack (i.e., a ten-value card as his hole card). The insurance bet pays 2-to-1 if the dealer has a Blackjack. Whenever the dealer has a Blackjack, he wins against all player hands except those that also have a Blackjack (which are a "push").

The minimum and maximum bets are typically posted on the table. The payoff on most bets is typically 1:1, meaning that the player wins the same amount as he bets. The payoff for a player Blackjack is typically 3:2, meaning that the casino pays $3 for each $2 originally bet. (There are many single-deck games which pay only 6:5 for a Blackjack.)

A Blackjack player will typically encounter many rule variations which affect the house advantage and therefore affect his chances of winning. Some rules are determined by law or regulation, others by the casino itself. Not all rules are posted, so the player may have to ask either beforehand or when the situation occurs. Over 100 variations exist.

A typically casino has a "house advantage" at Blackjack just as it does at any other casino game. If a particular casino game has a house advantage of 5%, it means that—over the long run—the casino will win about 5% of any initial bet. As long as the Blackjack player uses the best possible strategy (a strategy which is known as "Basic Strategy"), the house advantage in Blackjack is usually less than 1%. This is very favorable to the player compared to other casino games. Of course, many Blackjack players do not know Basic Strategy or do not follow it, so the true house advantage in those cases is much higher.

Each casino typically has a rule about whether or not the dealer hits soft 17, a rule which is typically printed on the Blackjack table itself. In a "S17" game, the dealer stands on all 17s. In a "H17" game, the dealer hits on soft 17s. Of course, the dealer always typically stands on hard 17s. In either case, the dealer typically has no choice; he either must or must not hit. The "Hit soft 17" game is less favorable to the player with about a 0.2% higher house advantage.

The number of decks used has a major effect on the player's chance of winning, because it affects the house advantage. All things being equal, fewer decks are typically more favorable for the Basic Strategy player. One reason of this is that player Blackjack is typically slightly more likely in single deck Blackjack (because Blackjack requires two different cards, by removing a card of one type (e.g., a Ten), getting one of a different type (e.g. an Ace) is more likely—and the effect is much bigger in a single deck game than in a multi-deck game), and if the player does have Blackjack, the dealer is significantly less likely to have Blackjack as well (which is a push), meaning that the player will get paid at normal Blackjack odds of 3:2 more often in the single deck game.

In reality, multi-deck games typically have otherwise better rules than single-deck games. The single deck game is much better than double deck, which is significantly better than four decks, while from six decks and up there is very little difference.

Surrender.

Some casinos offer a favorable option called "surrender," which allows the player to give up half his bet and not play out the hand. This option is sometimes referred to as "late" surrender because it occurs after the dealer has checked his or her hole card for a Blackjack. (When casinos first opened in Atlantic City, the surrender option was available before the dealer checked for Blackjack—a rule highly advantageous to the player—but this "early surrender" option soon disappeared.) Early surrender variations still exist in several countries. A player will typically only surrender on the very worst hands, because having even a 25% chance of winning will result in a better average return than giving up half of his bet. With early surrender, many players will surrender very often against a dealer Ace—even including hard 17.

Resplitting.

If a player splits a pair other than aces and a third card of that value appears, the player can usually resplit by putting up another bet equal to the original bet. Then there will be three bets on the table and three separate hands. Some casinos allow unlimited resplitting of cards other than aces, while others may limit it to a certain number of hands, such as four hands (for example, "resplit to 4").

Hit/Resplit Split Aces.

After splitting aces, the usual rule is that only one card will be dealt—the player cannot split, double or even hit. Rule variants include allowing resplitting aces and allowing the player to hit split aces. Allowing the player to hit Aces reduces the casino edge by about 0.13%, allowing resplitting Aces reduces the edge by about 0.03%.

Double after Split.

After splitting a pair, some casinos allow the player to "double down" on each of the new two-card hands. This is called "double after split" (DAS) and typically provides an advantage to the player of about 0.12%.

Double on 9/10/11 or 10/11 Only.

Often called "Reno" rules, this rule restricts the player to doubling down only on an initial player total of 10 or 11 (sometimes 9, 10, or 11—more common in Europe). It prevents doubling on soft hands such as soft 17(Ace-6), and is typically unfavorable for the player. It typically increases the house advantage by between 0.09% (8 decks) and 0.15% (1 deck) for the 9-11 rule, and between 0.17% (8 decks) and 0.26% (single deck) for the 10-11 rule. These numbers can vary due to interaction with other rules.

European No-Hole-Card Rule.

In most non-U.S. casinos, a 'no hole card' game is played. This means that there is no dealer hole card. This usually affects the player's strategy when deciding whether to double and/or split since a dealer Blackjack will result in the loss of the split and double bets. For instance, holding 11 against a dealer 10, the correct strategy is to double in a hole card game (where the player knows the dealer's second card is not an Ace), but to hit in a no hole card game. The no hole card rule typically adds approximately 0.11% to the house edge.

In some places, if the dealer is later found to have Blackjack, the player loses only his original bet but not any additional bets (doubles or splits). This has the same advantage as the usual game, and as such does not change basic strategy.

Altered Payout for Blackjack.

In some places, a Blackjack pays only 6:5 or even 1:1 instead of the usual 3:2. This is the typically most unfavorable common variation, increasing the house edge significantly more than most U.S. player restrictions. Since Blackjack occurs in approximately 4.8% of hands, the 1:1 game increases the house edge by 2.3%, while the 6:5 game adds 1.4% to the house edge. The 1:1 payout for video Blackjack may be a key reason why it has never approached the table version in terms of popularity. The 6:5 rule is most commonly employed on table Blackjack at single deck games—which are otherwise the most attractive game for a basic strategy player.

Insurance.

If the dealer's upcard is an ace, the player is offered the option of taking Insurance before the dealer checks his or her 'hole card'. Insurance is a side bet of up to half the original bet placed on a special portion of the table usually marked "Insurance Pays 2 to 1". This side bet is offered only when the dealer's exposed card is an ace. The idea is that the dealer's second card has a fairly high probability (nearly one-third) to be ten-valued, giving the dealer a Blackjack and typically results in a certain loss for the player. It is attractive (although not necessarily wise) for the player to insure against this possibility by making an "insurance" bet, which pays typically 2-to-1 if the dealer has a Blackjack, in which case the "insurance proceeds" will make up for the concomitant loss on the original bet. The insurance bet is lost if the dealer does not have Blackjack, although the player can still win or lose on the original bet.

Side Bets.

Some casinos offer a side bet with their Blackjack games. Examples include side bets based on getting three 7s, a three card poker-style bet, a pair, and many others. For a side bet, the player will typically put up an additional wager alongside his main bet. Typically the player can win or lose the side bet, regardless of the main game result. As there is little or no strategy involved, the house edge for side bets is usually much higher than the main game (which requires accurate play).

Variants.

Some of the current variants on Blackjack are listed below. This is not an exhaustive list, and more variants are invented every year. All are within the scope of the present invention.

Pontoon

Is an English variation of Blackjack with significant rule and strategy differences. However, in Australia and Malaysia, Pontoon is an unlicensed version of the American game Spanish 21 played without a hole card; despite the name, it bears no relation to English Pontoon.

Spanish 21

Provides players with many liberal Blackjack rules, such as doubling down any number of cards (with the option to 'rescue', or surrender only one wager to the house), payout bonuses for five or more card 21s, 6-7-8 21s, 7-7-7 21s, late surrender, and player Blackjacks always winning and player 21s always winning, at the cost of having no 10 cards in the deck (though there are jacks, queens, and kings).

21st Century Blackjack (Also known as "Vegas Style" Blackjack) is often commonly found in many California card rooms. In this form of the game, a player bust does not always result in an automatic loss; there are a handful of situations where the player can still push if the dealer busts as well, provided that the dealer busts with a higher total.

Certain rule changes are employed to create new variant games. These changes, while attracting the novice player, actually increase the house edge in these games. Double Exposure Blackjack is a variant in which the dealer's cards are both face-up. This game increases house edge by paying even money on Blackjacks and players losing ties. Double Attack Blackjack has very liberal Blackjack rules and the option of increasing one's wager after seeing the dealer's up card. This game is dealt from a Spanish shoe, and Blackjacks only pay even money.

The French and German variant "Vingt-et-un" (Twenty-one) and "Siebzehn and Vier" (Seventeen and Four) don't include splitting. An ace can only count as eleven, but two aces count as a Blackjack. This variant is seldom found in casinos, but is more common in private circles and barracks.

Chinese Blackjack is played by many in Asia, having no splitting of cards, but with other card combination regulations.

Another variant is Blackjack switch, a version of Blackjack in which a player is dealt two hands and is allowed to switch cards. For example, if the player is dealt 10-6 and 5-10, then the player can switch two cards to make hands of 10-10 and 6-5. Natural Blackjacks are paid 1:1 instead of the standard 3:2, and a dealer 22 is a push.

In Multiple Action Blackjack the player places between 2 or 3 bets on a single hand. The dealer then gets a hand for each bet the player places on a hand. This essentially doubles the number of hands a single dealer can play per hour. Splitting and Doubling are still allowed.

Recently, thanks to the popularity of poker, Elimination Blackjack has gained a following. Elimination Blackjack is a tournament format of Blackjack.

Many casinos offer optional side bets at standard Blackjack tables. For example, one common side-bet is "Royal Match", in which the player is paid if his first two cards are in the same suit, and receives a higher payout if they are a suited queen and king (and a jackpot payout if both the player and the dealer have a suited queen-king hand). Another increasingly common variant is "21+3," in which the player's two cards and the dealer's up card form a three-card poker hand; players are paid 9 to 1 on a straight, flush or three of a kind. These side bets typically offer worse odds than well-played Blackjack.

Despite the popularity of Blackjack, problems remain, especially as the game is played in casinos. One problem being is that players typically do not spend enough time on the tables and walk away earlier than what is preferable. A second problem is that the average bet is typically not large enough. It would be advantageous if a solution to these problems, and others that become evident herein, were solved.

BRIEF SUMMARY OF THE INVENTION

This patent discloses and claims a useful, novel, and unobvious invention for an improved Blackjack game in the field of wagering card games.

In a Blackjack game, one or more bonus or "Shrimp" cards are introduced into the card decks from which cards are dealt to the players. When a player is dealt a Shrimp card, the next time he is dealt a Blackjack, his winning is increased (preferably doubled). This provides an incentive for the player to increase his level of wagering and the time he plays at the Blackjack table after he has been dealt a Shrimp card. The Shrimp card is forfeit when the player leaves the table, and it is not transferable.

DETAILED DESCRIPTION

Figure 1:
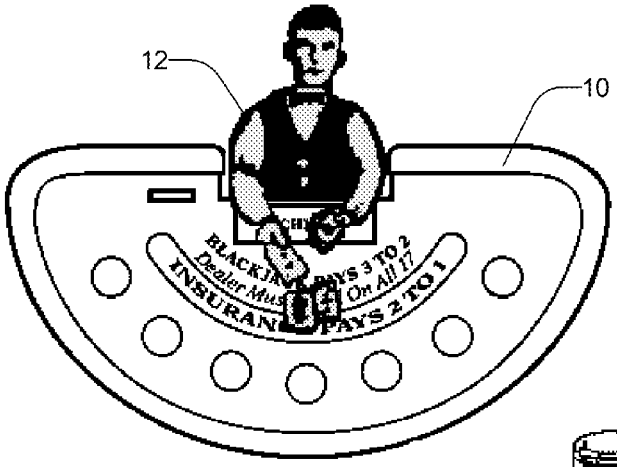
FIG. 1 is a drawing illustrating an exemplary Blackjack dealer and Blackjack table, in accordance with the Prior Art.
Figure 2:
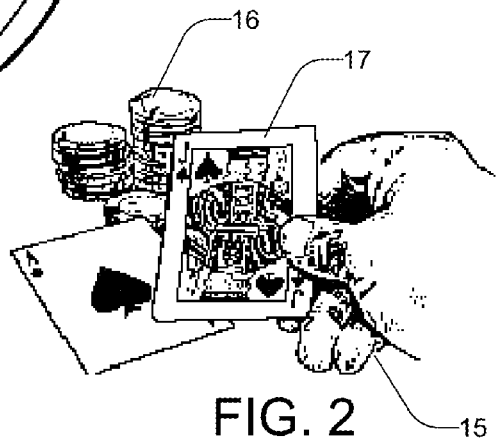
FIG. 2 is a drawing illustrating an exemplary Blackjack hand in addition showing a stack of chips held in the hand of a player (not shown) to be bet on a Blackjack table as shown in FIG. 1.

FIG. 1 is a drawing illustrating an exemplary Blackjack dealer 12 and Blackjack table 10, in accordance with the Prior Art. There is room around the Blackjack table 10 for seven players (not shown). FIG. 2 is a drawing illustrating an exemplary Blackjack hand 17 in addition showing a stack of chips 16 held in the hand 15 of a player (not shown) to be bet on a Blackjack table 10 as shown in FIG. 1.

Figure 3:
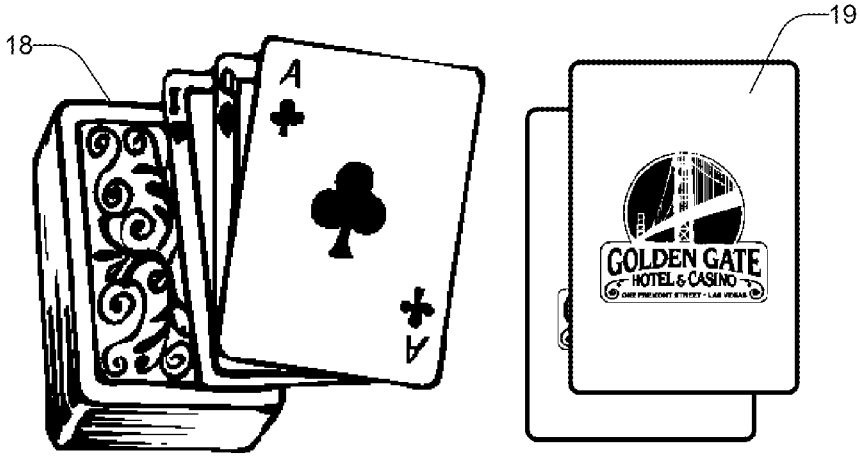
FIG. 3 is a an exemplary deck of playing cards that include two "Shrimp" or bonus cards, in accordance with one embodiment of the present invention.

FIG. 3 is a an exemplary deck of playing cards 18 that include two "Shrimp" or bonus cards 19, in accordance with one embodiment of the present invention.

Blackjack can be played with one or more decks of cards. In casinos today, it is typically played with six or eight decks shuffled together to combat card counting by players. The present invention is applicable, regardless of how many decks of cards involved. Cards may be dealt at a Blackjack table by hand, shoe, or autoshuffler. These and other methods of dealing are all within the scope of the present invention.

The present invention adds one or more bonus or "Shrimp" cards 19 to the decks of cards utilized in a standard Blackjack game. These bonus or Shrimp cards 19 are preferably noticeably different from the regular 52 cards in a typical deck of playing cards. In the illustration in FIG. 3, the bonus or "Shrimp" cards 19 contain the logo of a casino on their front surfaces. In an alternative embodiment, the bonus or Shrimp cards 19 may be Jokers, if the jokers are not utilized for other purposes. In a preferred embodiment, 1-4 bonus or additional cards are inserted into a Blackjack card set. Other numbers of bonus or Shrimp cards 19 are also within the scope of the present invention.

After the bonus or Shrimp cards 19 are inserted into a card set consisting of one or more decks of cards, the cards are dealt, as usual, except that when a player is dealt a bonus or Shrimp card 19, he is then dealt another card in its place, and he retains the bonus or Shrimp card 19 for use later on in the betting. Then, when the player gets a Blackjack hand, he wins an increased payout, for example, 2-1 in a preferred embodiment. This is significantly better than the normal 3-2 odds for a Blackjack hand. In a preferred embodiment, the player can place bets up to the table limits, identically to normal table play. The player can bet and win utilizing the bonus or Shrimp card previously dealt him until a termination event occurs. Some of the possible termination events are: winning with a Blackjack hand; a prespecified number of hands have been played since the Shrimp card 19 was dealt; or the player leaves the table. Other termination events or conditions are also within the scope of the present invention. In a preferred embodiment, a Shrimp or bonus card 19 is not transferable and is forfeit when the player gets up from the Blackjack table.

Figure 4:
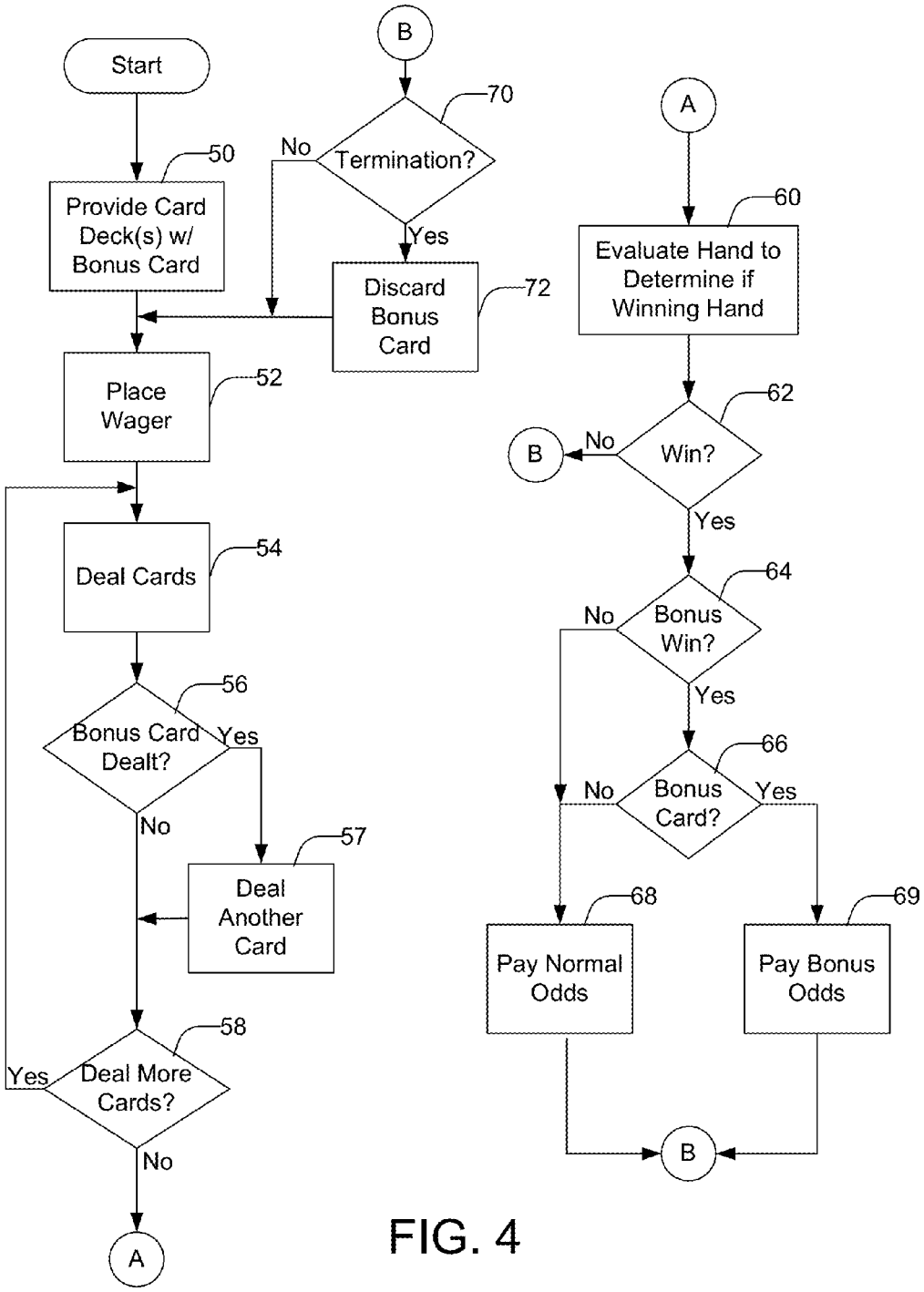
FIG. 4 is a flowchart of an exemplary operation of a Blackjack Game, in accordance with one embodiment of the present invention.

FIG. 4 is a flowchart of an exemplary operation of a Blackjack Game, in accordance with one embodiment of the present invention. One or more decks of cards 18 are provided with one or more bonus or Shrimp cards 19, step 50. At various times during the play of the game, the cards, including playing cards 18 and bonus/Shrimp cards 19 are shuffled and reshuffled, as required. A player makes a wager, step 52, typically limited to house limits. The player is then dealt cards. In Blackjack, the player will typically be dealt two cards at this time. If the player is dealt a bonus or Shrimp card 19, step 57, he is dealt another card to replace the bonus or Shrimp card 19, step 57, and he keeps the bonus or Shrimp card 19 for later use. He may have an opportunity to be dealt one or more cards, step 58, and if yes, then he is dealt the one or more cards, step 54, repeating the loop that includes checking for a bonus or Shrimp card 19, step 56. In Blackjack, the player is typically given the opportunity to take a third card if he believes that will better his hand. He may also split his hand in certain circumstances, such as being dealt a pair. Typically, the dealer will also be dealt cards in a similar manner, but since the dealer typically does not wager, this has been eliminated to simplify the flowchart.

Then, the player's hand is evaluated to see if he has a winning hand, step 60. This typically requires that it be compared to the dealer's hand in the case of Blackjack. If he did not win, he is done for this round, and the method continues to checking for a termination event or condition, step 70. Otherwise, if the player won, step 60, a test is made whether or not this was a bonus win, step 64. In the case of Blackjack, a bonus win will preferably be defined as a Blackjack. If he won, but did not have a bonus win, step 64, he is paid normal odds, step 68. Otherwise, if he had a bonus win, step 64, it is determined whether or not he has a bonus or Shrimp card 19, step 66. If he does not have a bonus or Shrimp card 19, step 66, he is paid normal odds for his win, step 68. Otherwise, he is paid bonus odds, step 69. In any case, a determination is now made whether or not there was a termination event, step 70. Some of the possible termination events are: having a bonus win (e.g. Blackjack) with a bonus or Shrimp card 19; leaving the table; having played a prespecified number of rounds after receiving the bonus or Shrimp card 19. Other termination events are also within the scope of the present invention. If the player has a bonus or Shrimp card 19 and a termination event has occurred, step 70, he discards or returns the bonus or Shrimp card 19, step 72. In any case, the player is now ready to make his next wager, step 52, if he wishes to continue playing the game.

One advantage of this invention is that it provides an incentive for players to spend more time on the tables and take longer to walk away. It would become less likely that a player would walk away with an unused Shrimp card 19 therefore increasing the time spent playing at the table. Another advantage is that it the average bet will often increase. It would become likely that the player with a Shrimp card 19 would increase the size of their wager to try to capitalize on their next Blackjack.

Wildcards have been utilized in games of chance for a long time. Indeed, there are variations of poker that explicitly utilize wild cards, such as "Follow the Queen" and "Chicago". Alternatively, many standard versions of poker can be played with wild cards, which can be specific cards, card values (such as "Deuces Wild"), Jokers, or other special cards inserted into a deck of cards. Invariably though, wild cards in poker involve substituting a different card value for a wild card. Thus, in some versions, if a player has two of a kind plus a wild card, he is treated as if he has three of a kind.

Wild cards have been introduced into Blackjack games. For example, U.S. Pat. No. 6,612,580 to Weldon designates one card as a cut/wild card, and the player dealt that card can select any value associated with any of the playing cards as the value he uses to play the wild card. In U.S. Patent Application No. 2008/0116641, to the same inventor, Weldon, the concept has been expanded to also potentially pay a bonus when a wild card is dealt to a player.

Part of what is different and unique about the present invention is that the "Shrimp" card 19 does not operate as a "wild card", as that term is typically utilized in card games. The player receiving it cannot use it to substitute for any other card in a deck of playing cards, as is done with "wild cards". Rather, it operates to increase (preferably by 50%) the payout when the next Blackjack is dealt to the player who had previously been dealt the "Shrimp" card 19. Combined with that, the player can increase his level of wagering (up to the table limits) when he has been dealt a "Shrimp" card 19, with the expectation that his winnings will be even greater at that time. As noted above, this provides an incentive for the player to increase his level of wagering and the time that he spends at the Blackjack table.

While an improved card game played at a card table has been disclosed, it should be understood that card games such as Blackjack are often played on gaming machines. Implementing the Shrimp cards on such a gaming machine is also within the scope of the present invention. Furthermore, there have been numerous variants of Blackjack developed, and the utilizing Shrimp cards with those variants is also within the scope of the present invention.

Those skilled in the art will recognize that modifications and variations can be made without departing from the spirit of the invention. Therefore, it is intended that this invention encompass all such variations and modifications as fall within the scope of the appended claims.

What is claimed is:

1. A method of providing a game of cards at a gaming machine, comprising:

providing at least one deck of playing cards containing at least one bonus card as the deck of cards by the gaming machine;

providing a first hand of the game to the player by the gaming machine;

repeating a first loop for a current hand in the card game comprising the steps of:

accepting a wager by the gaming machine from a player for the current hand in the card game;

repeating a second loop by the gaming machine as long as the player elects to be dealt more cards from the deck of cards for the player's current hand, the second loop comprising:

dealing one or more cards by the gaming machine from the deck of cards to the player for his current hand, the cards for the player's current hand dealt separately for any cards that were previously dealt during the previous first hand;

evaluating by the gaming machine the current hand of the player to determine whether the player won;

if the player won, determining by the gaming machine whether this win was a bonus win; and if this win was a bonus win, and the player has a bonus card dealt to the player by the gaming machine during the previous first hand, then paying the player at bonus odds by the gaming machine, otherwise paying the player at regular odds.

2. The method in claim 1 wherein the first loop further comprises:

checking for a termination event; and if the termination event has occurred, requiring a discard of the bonus card from the player.

3. The method in claim 2 wherein the termination event is the player having been paid the bonus odds after having the bonus win while holding the bonus card.

4. The method in claim 2 wherein the termination event is the player leaving the table.

5. The method in claim 2 wherein the termination event is the player having played a prespecified number of hands after having been dealt the bonus card.

6. The method in claim 1 wherein:

the bonus win is a Blackjack hand; and the bonus odds are 2-1.

7. The method in claim 1 wherein the card game is Blackjack.

8. A method of providing a Blackjack game by a gaming machine, comprising:

providing by the gaming machine at least one deck of playing cards containing at least one bonus card as a deck of cards;

providing a first hand of the game to the player by the gaming machine;

playing hands of Blackjack by the gaming machine wherein:

whenever a player is dealt a bonus card by the gaming machine, he can retain the bonus card and be dealt another card by the gaming machine the cards for the player's current hand dealt by the gaming machine separately for any cards that were previously dealt by the gaming machine during the previous first hand;

whenever the player wins with a Blackjack hand and has a bonus card which was dealt by the gaming machine to the player during the previous hand, he is paid at increased odds by the gaming machine; and whenever the player encounters a termination event in the Blackjack game provided at the gaming machine, he gives up the bonus card.

* * * * *